US009016174B2

(12) United States Patent
Lee et al.

(10) Patent No.: US 9,016,174 B2
(45) Date of Patent: Apr. 28, 2015

(54) RATCHET WRENCH

(76) Inventors: Tsan-Chang Lee, Taichung (TW); Yueh-Li Wang, Taichung (TW)

( * ) Notice: Subject to any disclaimer, the term of this patent is extended or adjusted under 35 U.S.C. 154(b) by 358 days.

(21) Appl. No.: 13/537,081

(22) Filed: Jun. 29, 2012

(65) Prior Publication Data

US 2014/0000415 A1 Jan. 2, 2014

(51) Int. Cl.
*B25B 13/46* (2006.01)

(52) U.S. Cl.
CPC ..... *B25B 13/463* (2013.01); *B25B 13/462* (2013.01); *B25B 13/461* (2013.01)

(58) Field of Classification Search
CPC ..... B25B 13/463
See application file for complete search history.

(56) References Cited

U.S. PATENT DOCUMENTS 6,862,955 B1 * 3/2005 Shu-Sui et al. ..... 81/60
7,044,029 B1 * 5/2006 Hopper et al. ..... 81/60
8,661,946 B2 * 3/2014 Lee et al. ..... 81/60

* cited by examiner

*Primary Examiner* — Bryan R Muller

(57) ABSTRACT

A ratchet wrench includes a reception hole defined through the function end of the wrench and a recess is defined in the inner periphery of the reception hole. A ratchet wheel is rotatably located in the reception hole. A pawl, a restriction member and a resilient member are received in the recess. The two ends of the resilient member respectively contact the pawl and the restriction member to bias the pawl to be engaged with the ratchet wheel. A restriction ring is located in the reception hole and has a rod extending therefrom, the rod extends into the recess. The restriction member is located between the rod and the inner periphery of the recess.

14 Claims, 12 Drawing Sheets

RATCHET WRENCH

FIELD OF THE INVENTION

The present invention relates to a ratchet wrench, and more particularly, to a ratchet mechanism for controlling the operation direction of the ratchet wrench.

BACKGROUND OF THE INVENTION

The conventional ratchet wrench 80 is disclosed in FIGS. 14 to 16 and generally comprises a reception hole 81 and a reception recess 82 defined through the function end of the wrench 80, the reception hole 81 and the reception recess 82 share a common axis. The diameter of the reception recess 82 is larger that of the reception hole 81. A recess 83 of smaller diameter is defined in the inner periphery of the reception recess 82. An engaging groove 84 is defined in an upper portion of the reception recess 82 and a first peripheral wall 85 is formed between the reception hole 81 and the reception recess 82 because of the difference of the two respective diameters. A second peripheral wall 86 is formed between the top portion of the recess 83 and the reception recess 82. When making the wrench 80, the drill can easily access the reception recess 82 because of the difference of the two respective diameters as mentioned above. When machining the reception recess 82 downwardly or horizontally, because the first peripheral wall 85 is located the lowest end in the vertical direction of the reception recess 82, surplus material is formed along the first peripheral wall 85. When using end milling tool or T-type blade to machine the recess 83 by moving the tool in the reception recess 82 horizontally and toward the handle of the wrench 80, the surplus material is formed on the second peripheral wall 86. A preferable way to remove the surplus material on the two positions is to make a groove 87 at the first peripheral wall 85 and to make a second groove 88 at the second peripheral wall 86, by using the lathe blade to remove the surplus material.

SUMMARY OF THE INVENTION

The present invention relates to a ratchet wrench and comprises a reception hole defined through the function end of the wrench and a recess is defined in the inner periphery of the reception hole. A ratchet wheel is rotatably located in the reception hole. A pawl, a restriction member and a resilient member are received in the recess. The two ends of the resilient member respectively contact the pawl and the restriction member to bias the pawl to be engaged with the ratchet wheel. A restriction ring is located in the reception hole and has a rod extending therefrom, the rod extends into the recess. The restriction member is located between the rod and the inner periphery of the recess. A restriction member is located in the recess and has a first plate, a second plate and a second plate. The rod is engaged with the first plate and the third plate is a curved plate and contacts the inner periphery of the recess.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
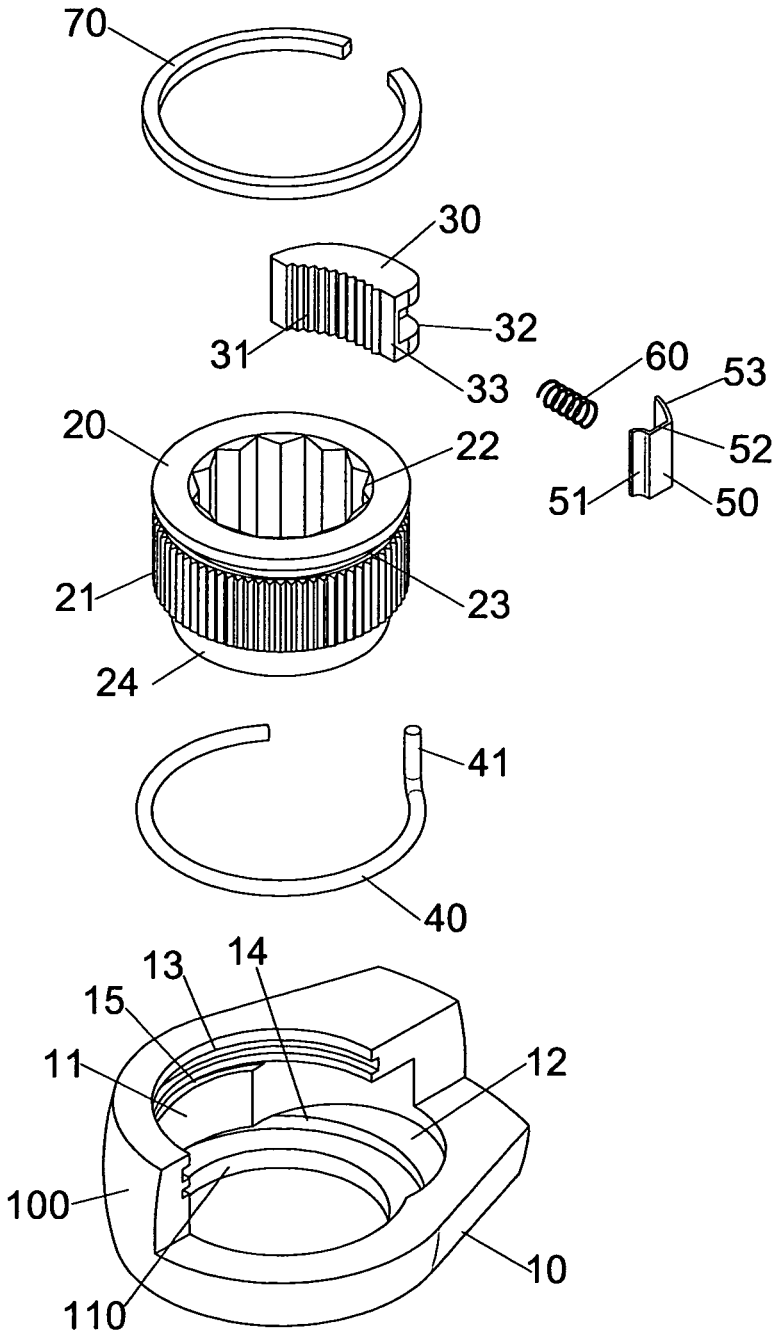
FIG. 1 is an exploded view to show the ratchet wrench of the present invention.
Figure 2:
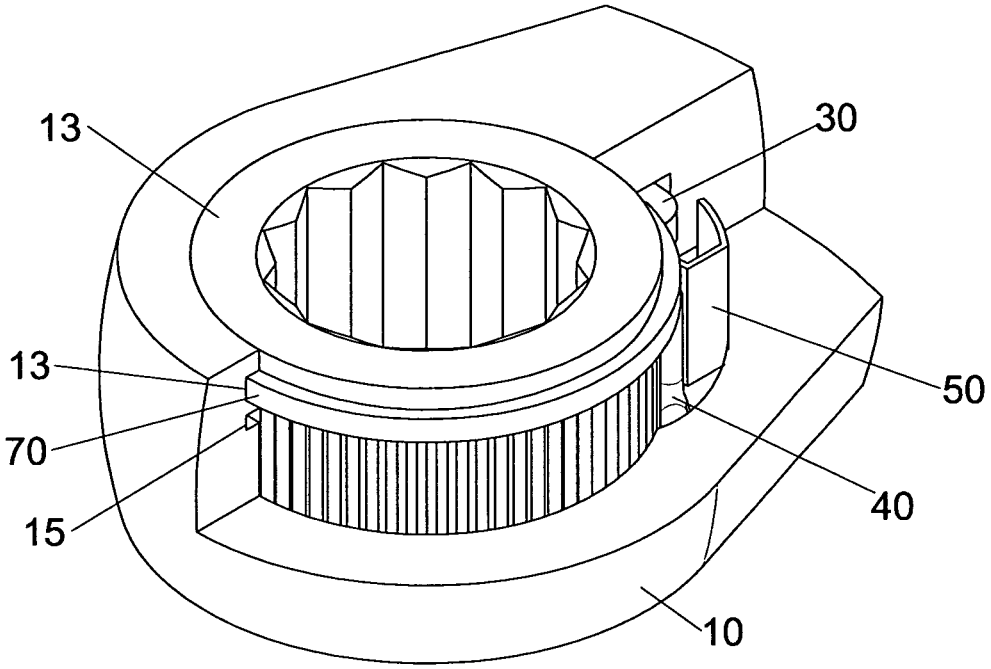
FIG. 2 is a perspective view, partially removed, to show the ratchet wrench of the present invention.
Figure 3:
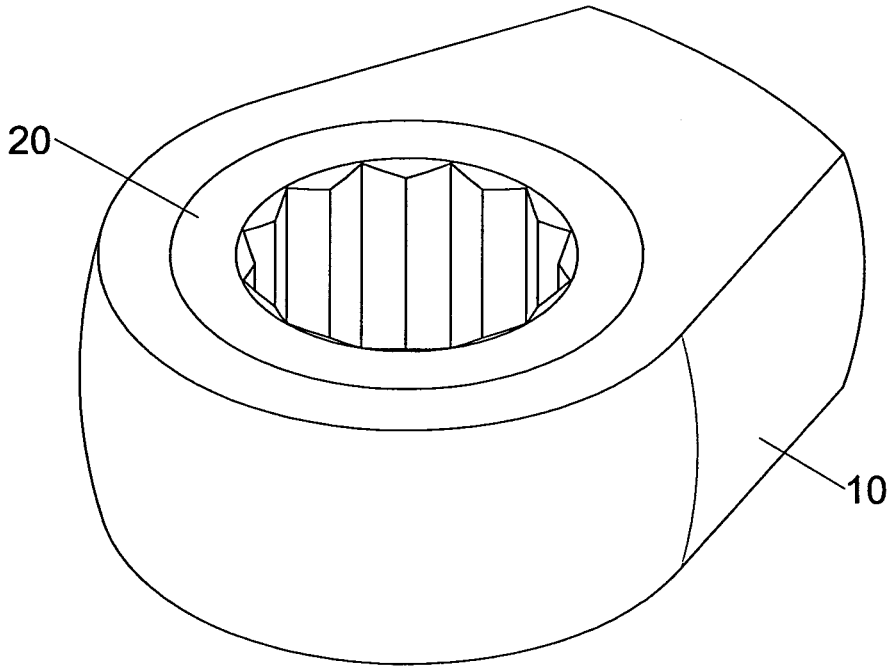
FIG. 3 is a perspective view to show the ratchet wrench of the present invention.
Figure 4:
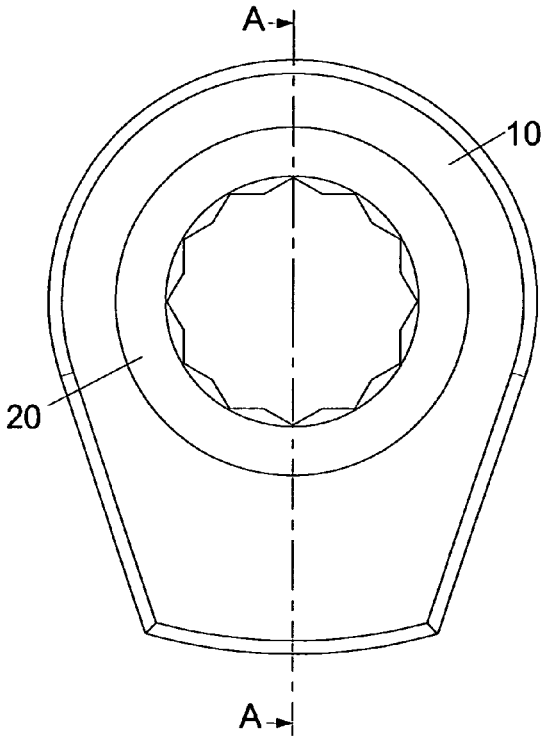
FIG. 4 is a top view of the ratchet wrench of the present invention.

Referring to FIGS. 1 to 5, the ratchet wrench 10 of the present invention comprises a ratchet wheel 20, a pawl 30, a restriction ring 40, a restriction member 50, a resilient member 60 and a clip ring 70.

The ratchet wrench 10 has a function end 100 which has a reception hole 11 defined therethrough and a peripheral wall 110 extends from the lower portion of the reception hole 11 so as to enclose the reception hole 11. A recess 12 is defined in the inner periphery of the reception hole 11 and the center of the recess 12 located within the reception hole 11. The reception hole 11 communicates with the recess 12. An engaging groove 13 is defined in the inner periphery of the upper portion of the recess 12. A first groove 14 is defined in the conjunction portion between the peripheral wall 110 and the reception hole 11. The first groove 14 communicates with the lower portion of the recess 12. A second grove 15 is defined in the inner periphery of the reception hole 11 and located below the engaging groove 13. The second groove 15 communicates with the recess 12.

The ratchet wheel 20 is rotatably located in the reception hole 11 and has first teeth 21 defined in the outer periphery thereof. An engaging portion 22 is located at the center of the ratchet wheel 20, wherein the engaging portion 22 can be a polygonal recess for receiving a bolt. Alternatively, the engaging portion 22 can be a rectangular rod for being connected with a socket. An outer groove 23 is defined in the outer periphery of the ratchet wheel 20 and located corresponding to the engaging groove 13. A circular protrusion 24 extends from the underside of the ratchet wheel 20 and is located within the peripheral wall 110.

The pawl 30 is located in the recess 12 and has multiple second teeth 31 formed on the first side thereof, the second teeth 31 are engaged with the first teeth 21 of the ratchet wheel 20. A recessed connection portion 32 is formed on the second side of the pawl 30. Two contact faces 33 are formed on two ends of the first side of the pawl 30.

The C-shaped restriction ring 40 tends to expand outward and is engaged with the first groove 14. A rod 41 extends from one end of the restriction ring 40. The rod 41 extends along the axial direction of the recess 12 and is engaged with the recess 12. The height of the rod 41 is smaller than the height of the recess 12. The rod 41 extends along the direction that is parallel to the axis of the reception hole 11.

The restriction member 50 is located in the recess 12 and at the same side of the rod 41. The restriction member 50 is a U-shaped member which has a first plate 51, a second plate 52 and a third plate 53. The first plate 51 has a recessed portion 510 defined in the outside thereof and the rod 41 is partially engaged with the recessed portion 510. The third plate 53 is a curved plate and contacts the inner periphery of the recess 12. The second plate 52 is a flat plate and the width of the second plate 52 is equal to the distance between the rod 41 and the inner periphery of the recess 12. The width of the second plate 52 is substantially matched with the diameter of the resilient member 60.

The resilient member 60 has a first end connected with the connection portion 32 of the pawl 30 and the second end of the resilient member 60 is located between the first and third plates 51, 53 and, contacts the second plate 52. The resilient member 60 biases the first plate 51 to contact the rod 41 of the restriction ring 40, the third plate 53 to contact the inner periphery of the recess 12, and the second teeth 31 to be engaged with the first teeth 21. The first and third plates 51, 53 clamp the end of the resilient member 60 so that the resilient member 60 is not disengaged from the recess 12 by the first, second and third plates 51, 52, 53 and the contact face 33.

The clip ring 70 is engaged with the engaging groove 13 and the outer groove 23 so that the ratchet wheel 20 is rotatably located in the function end 100.

As shown in FIGS. 4 to 7, the pawl 30 is located in the recess 12 and the resilient member 60 has the first end connected with the connection portion 32 of the pawl 30 and the second end of the resilient member 60 is located between the first and third plates 51, 53. The clip ring 70 is engaged with the engaging groove 13 and the outer groove 23. The relative positions between the ratchet wheel 20, the engaging groove 13, the first groove 14, the second groove 15 and the restriction ring 40 can be seen from FIG. 5.

Figure 8:
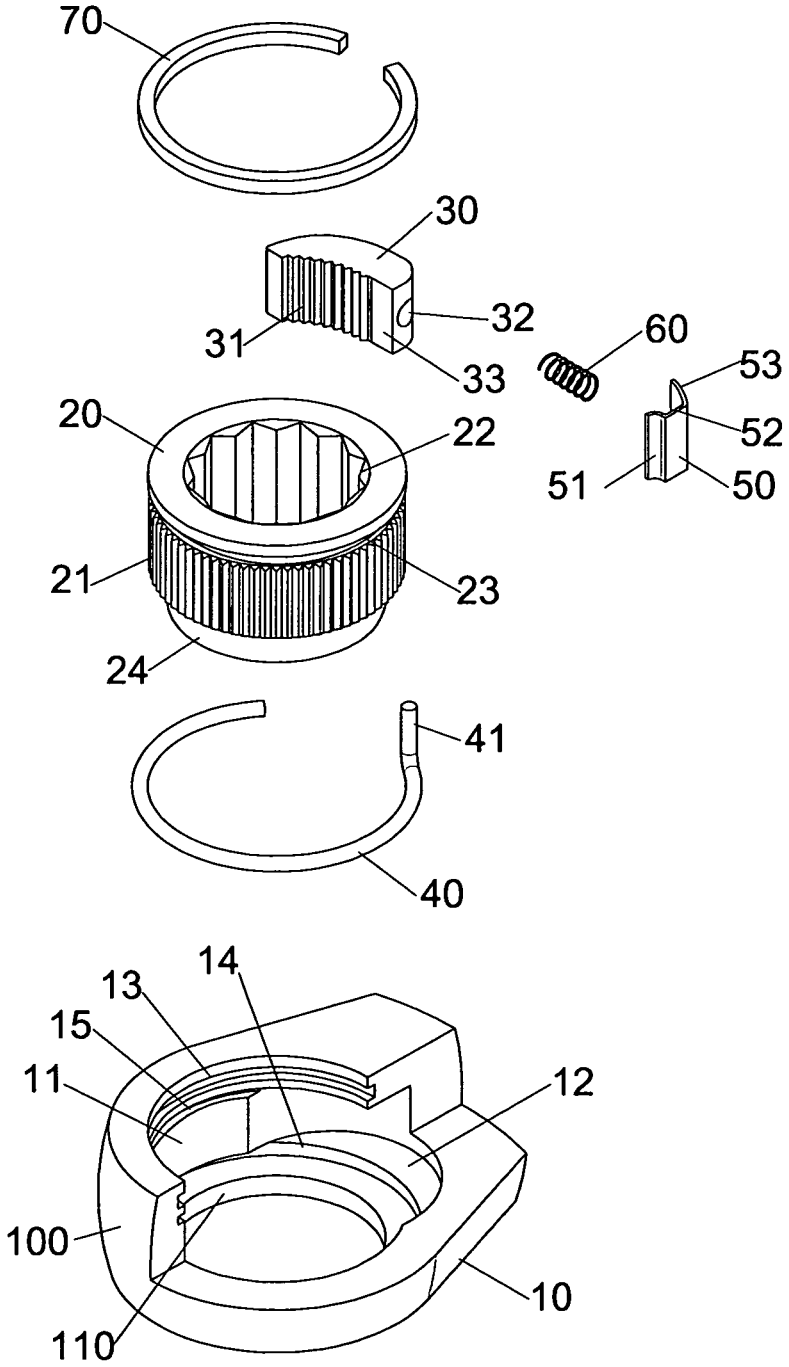
FIG. 8 is an exploded view to show the second embodiment of the ratchet wrench of the present invention.

As shown in FIG. 8, the connection portion 32 is a circular recess which is sized to receive the resilient member 60.

Figure 9:
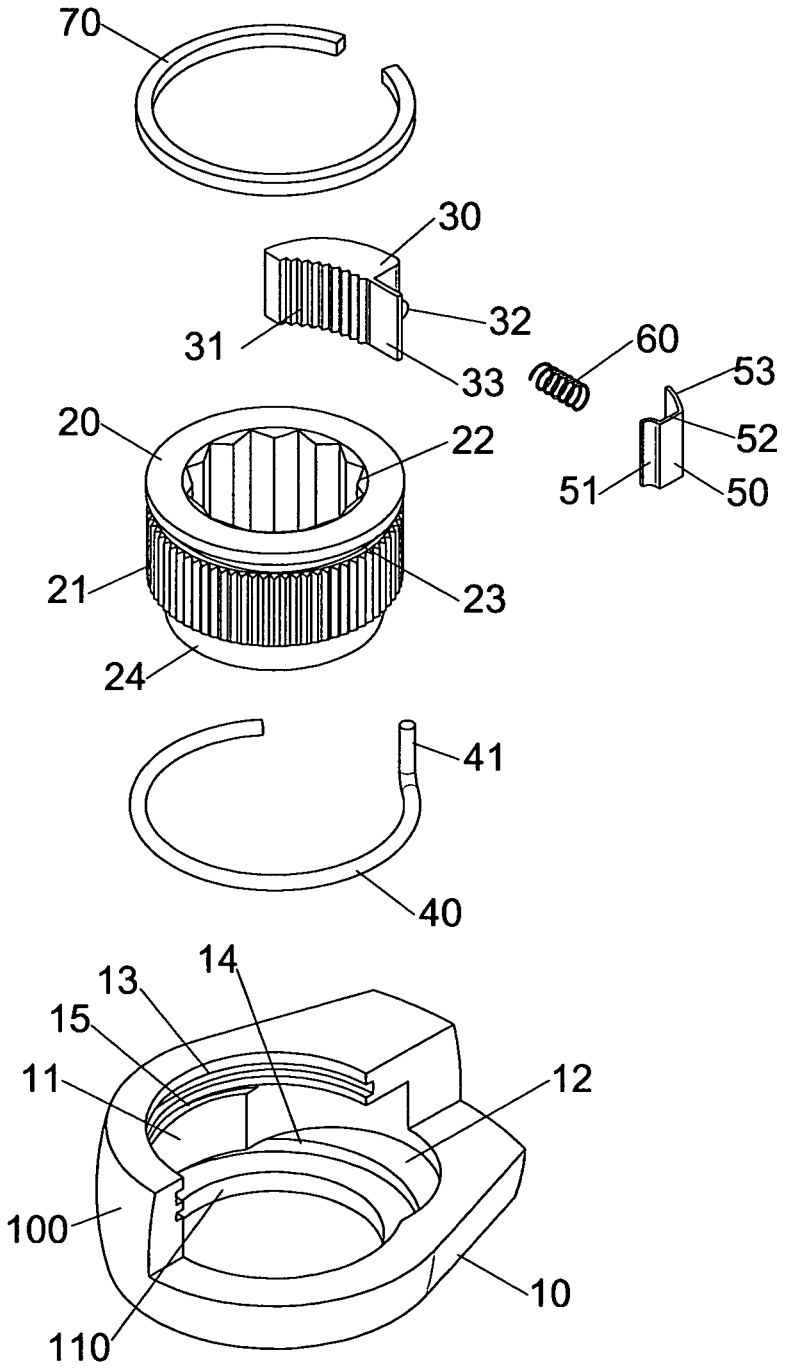
FIG. 9 is an exploded view to show the third embodiment of the ratchet wrench of the present invention.

As shown in FIG. 9, the connection portion 32 is a protrusion and the resilient member 60 is mounted to the protrusion.

Figure 10:
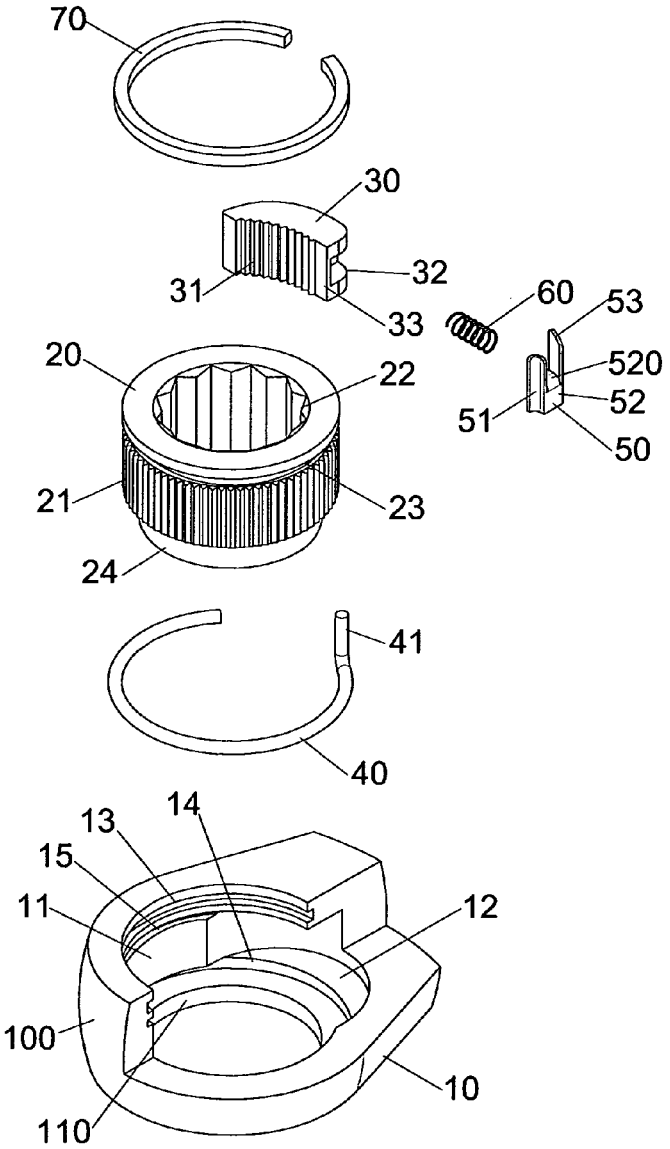
FIG. 10 is an exploded view to show the fourth embodiment of the ratchet wrench of the present invention.
Figure 11:
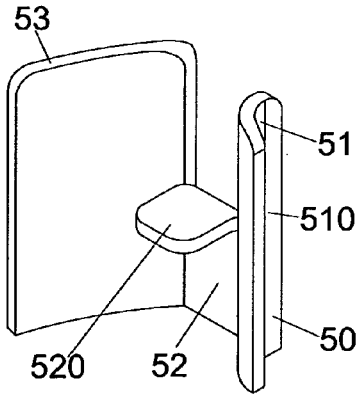
FIG. 11 shows the restriction plate used in the fourth embodiment of the ratchet wrench of the present invention.

FIGS. 10 and 11 show that the second plate 52 has a restriction portion 520 bent from the top thereof and the restriction portion 520 contacts the top of the resilient member 60 to restrict the resilient member 60 from moving up and down.

Figure 12:
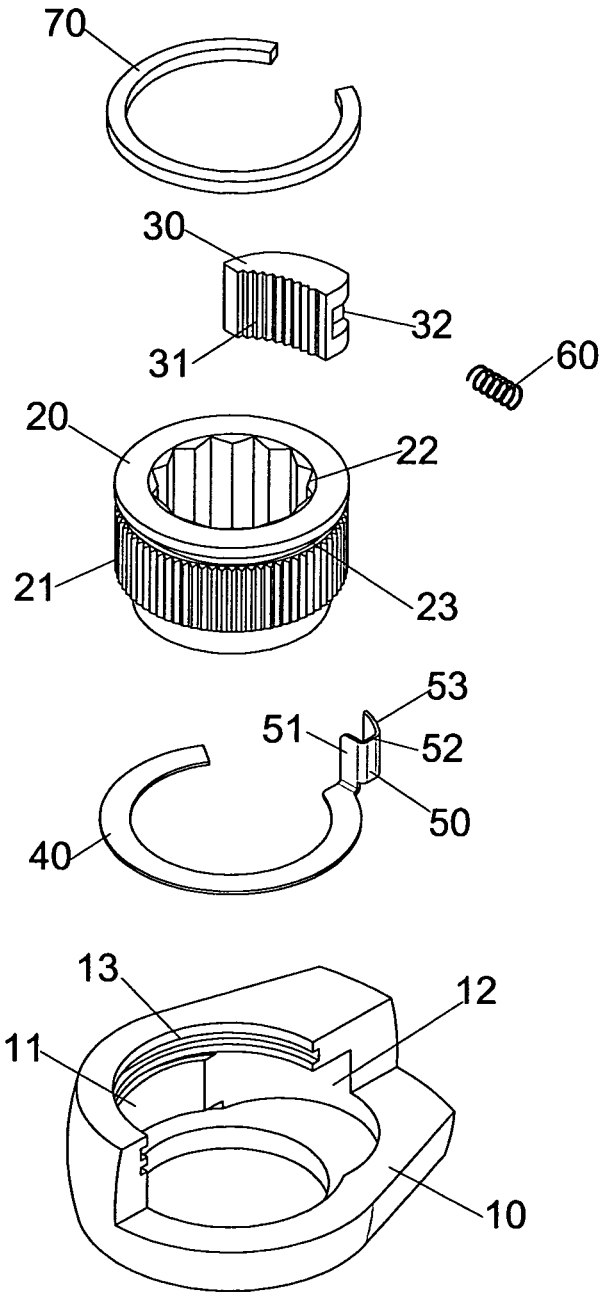
FIG. 12 is an exploded view to show the fifth embodiment of the ratchet wrench of the present invention.
Figure 13:
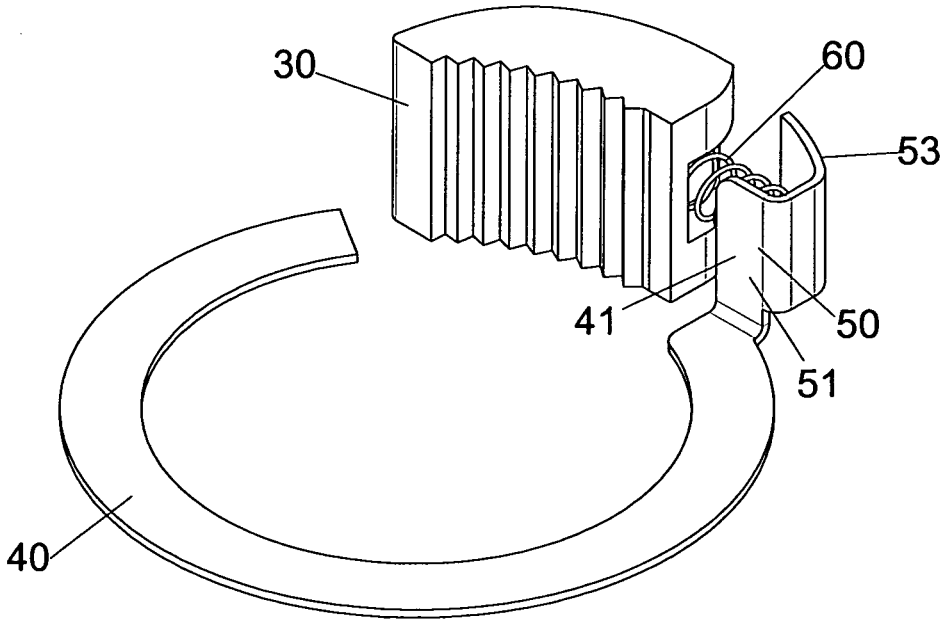
FIG. 13 shows the pawl, the restriction member, and the resilient member of the fifth embodiment of the ratchet wrench of the present invention.
Figure 14:
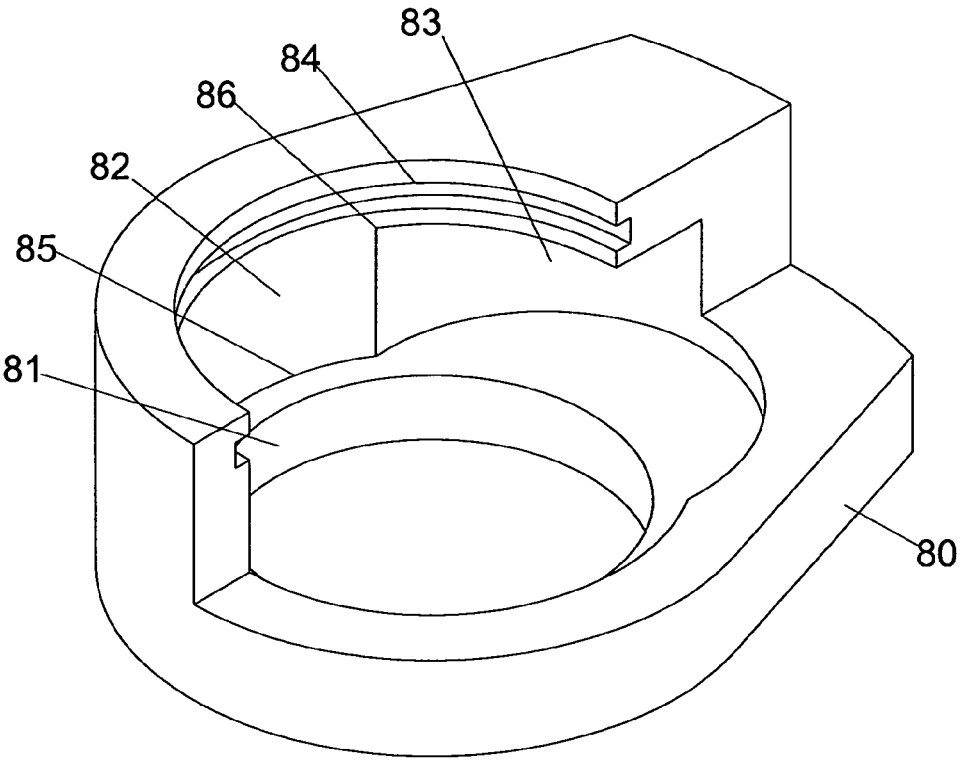
PRIOR ART FIG.14
FIG. 14 is a perspective view to show the conventional ratchet wrench.
Figure 15:
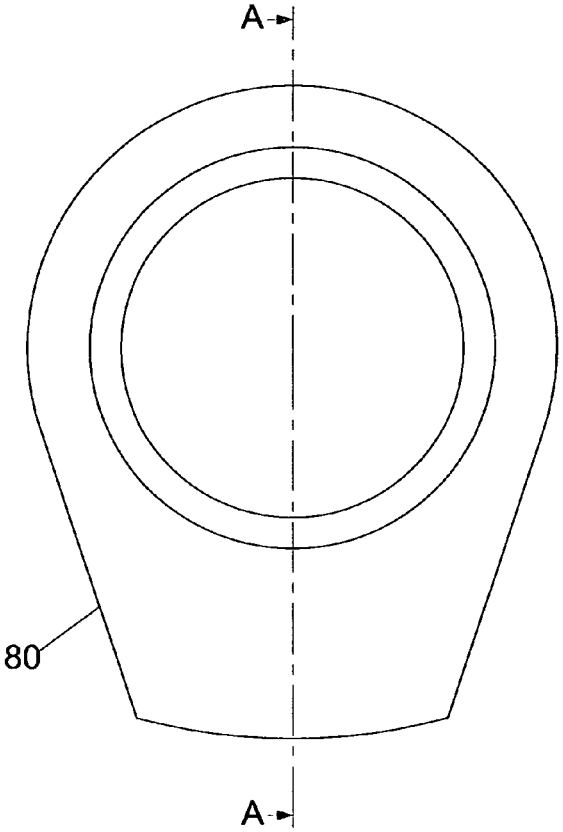
PRIOR ART FIG.15
FIG. 15 is a top view of the conventional ratchet wrench.

FIGS. 12 and 13 show that the rod 41 and the first plate 51 of the restriction member 50 are integrally formed as a one-piece which is easily installed and the manufacturing cost is reduced. The restriction ring 40 and the restriction member 50 are integrally formed by pressing from a single board and the one-piece is bent to meet desired needs.

Figure 5:
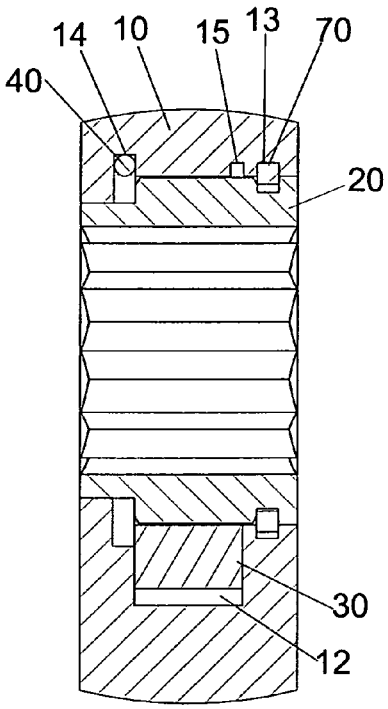
FIG. 5 is a cross sectional view, taken along line A-A in FIG. 4.
Figure 6:
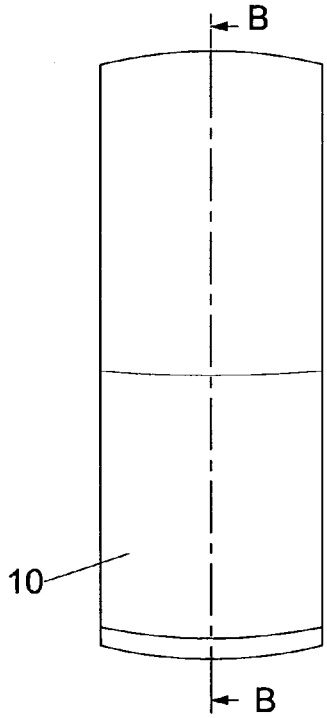
FIG. 6 is a side view of the ratchet wrench of the present invention.
Figure 7:
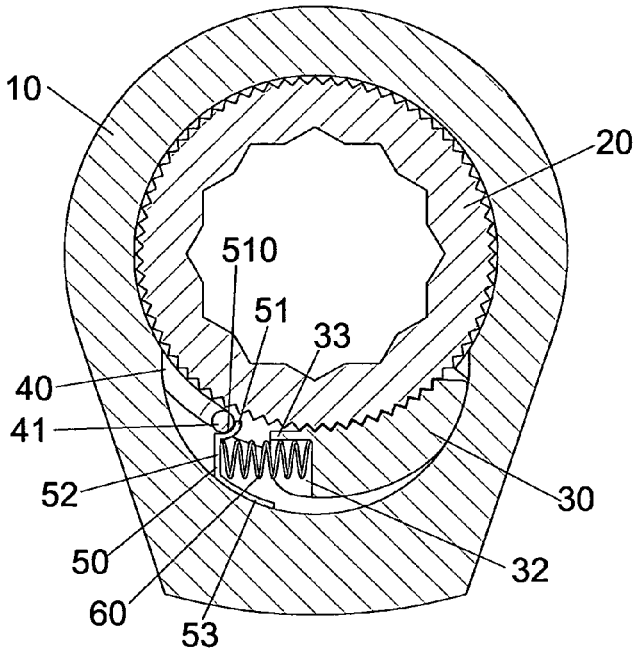
FIG. 7 is a cross sectional view, taken along line B-B in FIG. 6.
Figure 16:
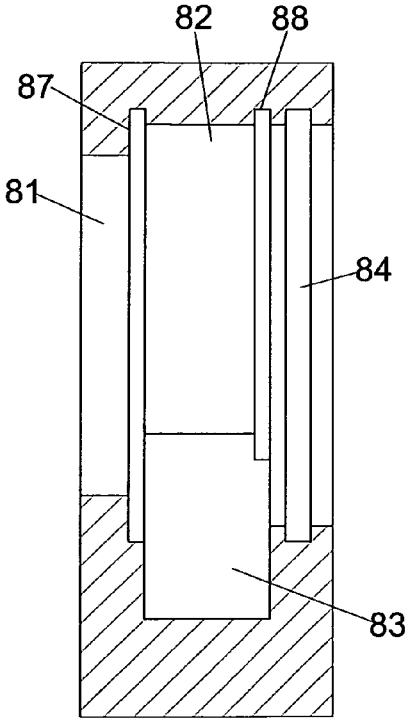
PRIOR ART FIG.16
FIG. 16 is a cross sectional view, taken along line A-A in FIG. 15.

Referring to FIGS. 5 and 16, the ratchet wrench 10 of the present invention provides the engaging groove 13, the first groove 14 and the second groove 15, which are similar to the engaging groove 84, the first grove 87 and the second groove 88 of the conventional wrench. The first groove 14 of the present invention receives the restriction ring 40 and does not need to make the fourth groove as the conventional ratchet wrench.

As shown in FIG. 5, the restriction ring 40 is received in the first groove 14 for the present invention and located corresponding to the circular protrusion 24 so that when the restriction ring 40 reaches the point of elastic fatigue, the ratchet teeth 21 are not worn out.

Referring to FIGS. 1 to 7, the restriction ring 40, the restriction member 50, the resilient member 60, and the pawl 30 are installed in the recess 12 in sequence, the ratchet wheel 20 and the clip ring 70 are then installed in the reception hole 11. The assembly is simple and easy.

Referring to FIGS. 1 to 7, the resilient member 60 has one end secured by the connection portion 32 and the other end is clamped by the restriction member 50, so that the resilient member 60 is securely located in the recess 12.

Referring to FIGS. 1 to 7, the second plate 52 is a flat plate to which the resilient member 60 contacts, so that the resilient member 60 is in a stable status.

Referring to FIGS. 1 to 7, the resilient member 60 is a commonly used part which is easily obtained in the market.

Referring to FIGS. 1 to 7, the resilient member 60 has tow wends thereof respectively positioned by the connection portion 32 and the restriction member 50, so that the ratchet teeth 21 are not in contact with the resilient member 60. When the ratchet wheel 20 is moved backward, the resilient member 60 is compressed and bent toward the recess 12, the ratchet teeth 21 are not in contact with the resilient member 60.

While we have shown and described the embodiment in accordance with the present invention, it should be clear to those skilled in the art that further embodiments may be made without departing from the scope of the present invention.

What is claimed is:

1. A ratchet wrench comprising:

a function end having a reception hole defined therethrough and a peripheral wall extending from the function end and enclosing the reception hole, a recess defined in an inner periphery of the reception hole and a center of the recess located within the reception hole, the reception hole communicating with the recess, an engaging groove defined in an inner periphery of the recess, a first groove defined in a conjunction portion between the peripheral wall and the reception hole, the first groove communicating with the recess;

a ratchet wheel rotatably located in the reception hole and having first teeth defined in an outer periphery thereof, an engaging portion located at a center of the ratchet wheel, a circular protrusion extending from an underside of the ratchet wheel;

a pawl located in the recess and having multiple second teeth formed on a first side thereof, the second teeth engaged with the first teeth, a connection portion formed on a second side of the pawl;

a C-shaped restriction ring engaged with the first groove and having a rod extending therefrom, the rod extending along an axial direction of the recess and engaged with the recess, a height of the rod is smaller than a height of the recess;

a restriction member located in the recess and being a U-shaped member which has a first plate, a second plate and a third plate, the first plate having a recessed portion defined in an outside thereof, the rod engaged with the recessed portion, the third plate being a curved plate and contacting the inner periphery of the recess, and a resilient member having a first end connected with the connection portion of the pawl and a second end of the resilient member located between the first and third plates and contacting the second plate, the resilient member biasing the first plate to contact the restriction ring, the third plate contacting the inner periphery of the recess, and the second teeth engaged with the first teeth.

2. The wrench as claimed in claim 1, wherein the connection portion is a recessed portion and two contact faces are formed on two ends of the first side of the pawl.

3. The wrench as claimed in claim 2, wherein the first end of the resilient member is located in the recessed connection portion of the pawl.

4. The wrench as claimed in claim 1, wherein the second plate is a flat plate and a width of the second plate is equal to a distance between the rod and the inner periphery of the recess.

5. The wrench as claimed in claim 1, wherein the second end of the resilient member is held between the first and third plates.

6. The wrench as claimed in claim 1, wherein the second plate has a restriction portion bent from a top thereof to restrict the resilient member.

7. The wrench as claimed in claim 1, wherein the rod and the restriction member are two individual members, the first plate has the recessed portion defined in the outside thereof, the rod is engaged with the recessed portion.

8. The wrench as claimed in claim 1, wherein the connection portion is a recessed portion.

9. The wrench as claimed in claim 1, wherein the connection portion is a protrusion.

10. The wrench as claimed in claim 1, wherein a top and a bottom of the recess are enclosed by upper and lower surfaces of the function end.

11. The wrench as claimed in claim 1, wherein a second grove is defined in the inner periphery of the reception hole and located below the engaging groove, the second groove communicates with the recess.

12. The wrench as claimed in claim 1, wherein an outer groove is defined in the outer periphery of the ratchet wheel and a clip ring is engaged with the engaging groove and the outer groove.

13. The wrench as claimed in claim 1, wherein the engaging portion is a polygonal recess which is adapted to receive a bolt.

14. The wrench as claimed in claim 1, wherein the engaging portion is a rectangular rod which is adapted to be connected with a socket.

* * * * *